US005916117A

United States Patent [19]

Koltze

[11] Patent Number: 5,916,117

[45] Date of Patent: Jun. 29, 1999

[54] YARN GUIDE FOR A POT SPINNING MACHINE

[75] Inventor: Karl Koltze, Mönchengladbach, Germany

[73] Assignee: W. Schlafhorst AG & Co., Germany

[21] Appl. No.: 08/985,158

[22] Filed: Dec. 4, 1997

[30] Foreign Application Priority Data

Dec. 6, 1996 [DE] Germany ..... 19650598

[51] Int. Cl.[6] ..... D01H 1/08

[52] U.S. Cl. ..... 57/76; 57/281; 57/312

[58] Field of Search ..... 57/76, 77, 281, 57/312

[56] References Cited

U.S. PATENT DOCUMENTS

| | | | |
|---|---|---|---|
| 3,098,343 | 7/1963 | Negishi | 57/76 |
| 3,205,645 | 9/1965 | Kato | 57/76 |
| 5,515,672 | 5/1996 | Koltze et al. | 57/76 |
| 5,699,658 | 12/1997 | Koltze et al. | 57/312 |

FOREIGN PATENT DOCUMENTS

| | | | |
|---|---|---|---|
| 43 24 039 A1 | 7/1993 | Germany . | |
| 68574 | 9/1951 | Netherlands | 57/76 |

*Primary Examiner*—William Stryjewski
*Attorney, Agent, or Firm*—Kennedy, Covington, Lobdell & Hickman

[57] ABSTRACT

A pot spinning machine for forming a spinning cop includes a spinning pot onto an interior of which yarn is deposited to form a spinning cake; a yarn guide which deposits the yarn onto the spinning pot to form the spinning cake; a yarn carrier onto which the yarn is rewound from the spinning cake to form the spinning cop; and a lifting member that engages, moves, and positions the yarn carrier with respect to the spinning pot. The yarn guide comprises a yarn passage defined only by the yarn carrier through which the yarn passes in direct exposure to said yarn carrier for deposit in the spinning pot. A method for forming a spinning cop includes depositing yarn onto an interior of a spinning pot of the pot spinning machine to form a spinning cake; and rewinding the spinning cake onto a yarn carrier to form a spinning cop. The step of depositing yarn to form the spinning cake includes guiding the yarn onto the interior of the spinning pot by passing the yarn through a passage defined only by the yarn carrier while moving the yarn carrier relative to the spinning pot.

11 Claims, 4 Drawing Sheets

YARN GUIDE FOR A POT SPINNING MACHINE

FIELD OF THE INVENTION

The present invention relates to a pot spinning device, wherein a yarn guide tube extends into a rotating spinning pot and relative movement between the spinning pot and the yarn guide the during the spinning process deposits yarn delivered through the tube in layers on the inner wall of the spinning pot as a spinning cake which is thereafter rewound onto a yarn carrier.

BACKGROUND OF THE INVENTION

During pot spinning, the spun yarn is initially deposited as a so-called spinning cake on the interior surface of a pot-like or tube-like body. This yarn cake must be rewound onto an empty bobbin introduced into the spinning pot, by means of which a spinning cop is created, such as is known from ring spinning machines. Such a spinning cop can then be placed into a winding machine for rewinding. Thus, pot spinning requires an additional process step in contrast to ring spinning.

In order to speed up rewinding of the spinning cake onto the empty bobbin and to automate this step, it is known from German Patent Publication DE 43 24 039 A1 for the empty bobbins to be held on the yarn guide tube during spinning and, following rewinding of the spinning cake, to be automatically placed on support bodies of a transport system, on which the empty bobbins are also conveyed.

In the process of doffing the finished spinning cop from the guide tube in accordance with the known method, it is necessary for the spinning cop to be pulled off the yarn guide over its entire length, and for the new empty bobbin to be pushed on the yarn guide tube. Since such a doffing process takes place outside of the spinning pot, the overall pot spinning device must have a structural height of more than twice the length of an empty bobbin in addition to the spinning pot height to perform a changing operation. As a result, the structural height of the spinning station and that of the machine is increased. Furthermore, the outlay required for achieving a stable and exactly straight guidance over the long process distances is great, particularly in view of the need to provide for receiving the empty bobbins on the yarn guide tube and the placement of the spinning cop on the support bodies.

OBJECT AND SUMMARY OF THE INVENTION

It is accordingly an object of the instant invention to improve the automatic doffing process on a pot spinning machine.

This object is attained in accordance with the present invention by providing a pot spinning device which basically comprises a rotatable spinning pot, yarn guide means extendable into the spinning pot for delivering a yarn thereinto, and means for executing relative movement between the spinning pot and the yarn guide means for depositing the yarn in layers on the inner wall of the spinning pot in the form of a spinning cake. Basically, the present invention contemplates that the yarn guide means is constituted as a yarn carrier for rewinding of the yarn cake thereonto, the yarn carrier being detachable following rewinding of the yarn cake to be exchanged with an empty yarn carrier for ongoing performance of a spinning process.

By means of the invention, doffing in a pot spinning device is made easier in comparison with known doffing processes, in that the yarn carrier itself takes on the function of a yarn guide. The yarn cake can be rewound on the outer circumferential surface of the yarn carrier, while an inner hollow channel is used for yarn guidance. The structural height of a spinning station can be considerably reduced in comparison with pot spinning machines wherein doffing of an empty bobbin pushed over the yarn guide tube is automated, because only the height of the yarn carrier pulled out of the pot, which also preforms the function of the yarn guide, is required.

Since the interior of a conventional yarn tube has too wide an inner chamber for an exactly centered guidance of the yarn in the spinning pot axis, an advantageous embodiment of the invention provides a conduit acting as a yarn guide tube fastened at centerline within a conduit of the diameter of a conventional empty bobbin.

A yarn carrier embodied as a solid body, for example made of a light plastic material in the shape of an empty bobbin and with a central bore acting as the yarn guide tube, is simple to produce.

For automatic handling, the yarn carriers have a device for engagement and centering on one end, which can consist of a groove encircling the external diameter, for example, which is engagable by a gripping tool. The outlet opening for the yarn is then arranged opposite the engagement and centering device. A symmetrical design of the yarn carriers, i.e., an arrangement of the outlet openings and engagement and centering grooves at both ends, is advantageous for avoiding the need for alignment in accordance with the yarn outlet opening when equipping a machine with yarn carriers.

In order to assure the secure and uninterrupted depositing of the yarn, in particular with a so-called cop traverse for building up the yarn layers of the spinning cake, the deflecting edge of the outlet opening for the yarn used for yarn guidance extends beyond the lower end of the yarn carrier, viewed in the longitudinal direction of the yarn carrier. In this manner, engagement of the traveling yarn with the lower end of the carrier is avoided, which could negatively affect the spinning conditions and the properties of the yarn.

It is advantageous for a mouthpiece defining the yarn outlet opening to be fitted into the yarn carrier to protect the yarn to the greatest degree and to be easily exchangeable in case of wear or damage. Exchangeable mouthpieces made of metal or ceramic material meet this requirement and allow a simple exchange in case of wear.

Further objects, features and advantages of the invention will be explained in detail below by means of exemplary embodiments with reference to the accompanying drawings.

DETAILED DESCRIPTION OF THE PREFERRED EMBODIMENTS

Figure 1:
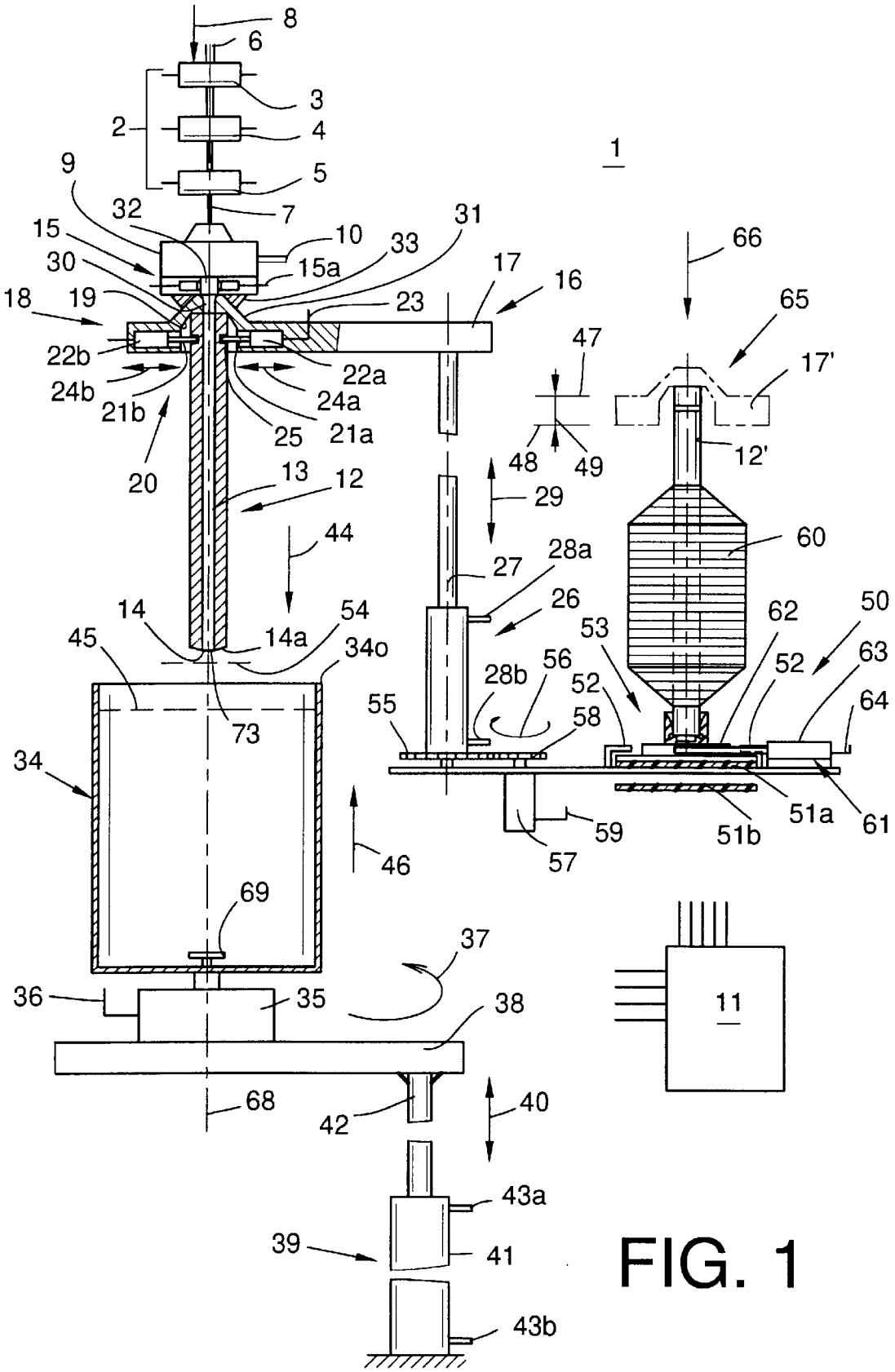
FIG. 1 is a schematic elevational view, partially in vertical cross-section, of a pot spinning device in accordance with the present invention, wherein the yarn carrier is located on the piecing aid for threading the sliver.

Referring now to the accompanying drawings, a pot spinning machine 1 in accordance with the present invention is schematically represented in FIG. 1. A sliver 6 is drafted into a roving 7 by a drafting system, identified as a whole by 2, of which two pairs of drafting rollers 3 and 4 and a pair of delivery rollers 5 are represented, and is fed in the direction of the arrow 8 to a stationary injector 9, which serves as a pneumatic piecing aid. The roving 7 is introduced into a yarn carrier 12 by means of compressed air supplied to the injector 9 via a line 10. In the yarn carrier 12, the roving 7 is conducted through a channel or bore 13 in order to exit as a yarn, not represented here, through an outlet opening 14 at the lower end of the carrier 12. The presence of the sliver 7 is registered by a sensor 15 and reported via a signal line 15*a* to a microprocessor or other suitable control device 11. The yarn carrier 12 is supported by a holder, identified as a whole by 16. The holder consists of an arm 17 having a truncated conical portion 31 defining a frustoconical-shaped recess 19 in which the yarn carrier 12 to be supported may be centered in a predetermined position and held in such position by a gripper 20 of a centering and gripping device 18 supported by the arm 17. The gripper 20 consists of two slides 21*a* and 21*b*, horizontally arranged in the arm 17 in opposition to each other within respective semicircular openings in the arm, not represented here. The two slides 21*a* and 21*b* can be moved toward or away from each other by respective actuators 22*a* or 22*b* controlled via a line 23 by the control device 11, as represented by the two-headed arrows 24*a* or 24*b*.

So that the yarn carrier 12 can be held securely by this gripper 20, the carrier 12 in accordance with the instant exemplary embodiment is formed with a groove 25 encircling one end. If a yarn carrier 12 is to be grasped by the centering and gripping device 18, first the holder 16 is lowered over a ready empty yarn carrier 12, which is performed by means of a pneumatic cylinder 26. To this end, the arm 17 of the holder 16 is fastened on the piston 27 of the lifting and lowering device 26, whereby the holder 16 can be lifted and lowered by means of appropriate feeding and venting of compressed air via the line 28*a* and 28*b*, controlled by the control device 11, as indicated by the two-headed arrow 29.

The centering and gripping device 18 is lowered with the gripper 20 open onto an empty yarn carrier, causing the tip of the latter to be centered in the cone-shaped recess 19. Thereafter, the slides 21*a* and 21*b* are extended toward each other by means of the actuators 22*a* and 22*b*, triggered by the control device 11, so that they engage in the groove 25 of the carrier 12, whereby the yarn carrier can be securely held. In the process, a channel 13 formed centrally through the length of the carrier 12 is oriented in centered alignment with a central opening 30 in the frustoconical recess 19 defined by the truncated conical arm portion 31 for coupling the carrier 12 with the pneumatic piecing aid 9. To this end, the pneumatic piecing aid 9 has a centering ring 33 around an outlet opening 32 which ring 33 is conically shaped for receiving the truncated cone 31 of the holder 16 during the operation of the pneumatic piecing aid 9, thereby to align the opening 30 through the frustoconical portion 31 and the channel 13 in the yarn carrier 12 with the outlet opening 32 of the pneumatic piecing aid 9. As a result, it is possible to feed the roving 7 into the channel 13 of the yarn carrier 12 by means of the pneumatic piecing aid 9, which situation is represented in FIG. 1.

As shown in FIG. 1, an empty spinning pot 34 stands underneath the yarn carrier 12 in a position for the start of a spinning operation. The spinning pot 34 is driven by a motor 35, which is controlled via a line 36 by the control device 11, as indicated by the arrow 37. The axis 68 of the spinning pot 34 is aligned with the channel 13 of the yarn carrier 12. The spinning pot 34 with its drive 35 is seated on a lifting beam 38, which can be raised and lowered by a lifting and lowering device 39 for a spinning operation as well as for changing the yarn carrier, as indicated by the arrow 40. In the instant case, the lifting and lowering device consists of a pneumatic cylinder 41, whose piston 42 is connected with the lifting beam 38 to be lowered or raised by the control device 11 by means of appropriate control of the compressed air fed via the lines 43*a* or 43*b*.

For starting the spinning operation, the yarn carrier 12 is lowered by means of the lifting and lowering device 26 into a position in the direction of the arrow 44 until the outlet opening 14 of the carrier 12 is disposed at the level 45 to begin placement of the first yarn windings in the spinning pot. The buildup of the spinning cake in the spinning pot is carried out, with the aid of the lifting and lowering device 39, by initially raising the spinning pot in the direction of the arrow 46 out of the position represented in FIG. 1, and then alternatingly lowering and again raising the spinning pot to cause the yarn exiting the carrier 12 to be placed in layered windings progressively along the inner surface of the spinning pot. During the process, the lifting and lowering device 26 is actuated to cause the arm 17 of the empty bobbin holder 16 to perform a traversing movement between the upper position 47 and the lower position 48, as indicated by the two-headed arrow 49, for building the yarn windings in a so-called cop form. A stationary spinning pot and a holding device which performs the layer buildup as well as the total lift is also conceivable. So that during the performance of the cop lift the yarn does not travel over the entire front end 14*a* of the carrier 12, the latter is configured slightly in a conical shape towards the outlet opening 14. Furthermore, the deflecting edge 73 of the outlet opening 14, which is used for yarn guidance, is disposed forwardly of the conical front end 14*a*.

A transport device 50 is provided in the instant exemplary embodiment, consisting of a conveyor belt with an upper belt run 51*a* and a lower belt run 51*b*. Lateral guides 52 are arranged alongside the upper run 51*a* of the conveyor belt for guiding transport holders 53 for bringing empty yarn carriers to the pot spinning station and transporting away finished spinning cops. The design of the transport holders is explained in more detail hereinafter with reference to FIG. 6.

Following the rewinding of the spinning cake onto the yarn carrier 12 (which occurs in a known manner which need not be described herein), the empty spinning pot is moved downwardly into its initial position represented in FIG. 1 and the arm 17 of the holder 16 is raised into a position wherein the outlet opening 14 of the yarn carrier 12 is located at the level of the position 54 above the spinning pot 34. Thereafter the entire lifting and lowering device 26, which is fastened on a turntable 55, is pivoted toward the transport device 50, as indicated by the arrow 56, by means of a motor 57 whose pinion 58 drives the turntable 55. The motor 57 is actuated to execute this pivoting motion by the control device 11 via the control line 59.

In the instant exemplary embodiment, a transport holder 53 with a fully wound spinning cop 60 stands on the transport device 50 to be transported away. The holder 53 is restrained by a blocker 61 consisting of a pivotable lever 62 which is pivoted by an actuator 63 to extend across the conveyor belt 51*a* when it is triggered by the control device 11 via the signal line 64. The blocker retains the transport holder for the spinning cops or other yarn carriers in the transfer position 65, as represented in FIG. 1.

Once the arm 17 with the spinning cop released from the spinning pot 34 has reached the transfer position 65, it is lowered in the direction of the arrow 66 until the arm 17 has reached the position 17' shown in broken lines and the yarn carrier 12' has accordingly been placed into the transport holder 53. Thereafter, the gripper 12 is opened, the arm 17 is lifted and, after having been released by the blocker 61, the spinning cop 60 can be transported away by the conveyor belt. Thereafter, another transport holder supporting an empty yarn carrier (not represented here), which has been standing behind the empty transport holder 53 while the spinning cop was placed thereon, is delivered by the conveyor belt to the transfer position 65 and held in place thereat by the blocker 61. By again lowering the arm 17 into the position 17' and closing of the gripper 20, the empty yarn carrier can be removed upwardly from the transport holder 53 and can be pivoted into position above the spinning pot to begin a fresh spinning process by moving the empty yarn carrier against the pneumatic piecing aid 9 to receive the incoming roving.

Figure 2:
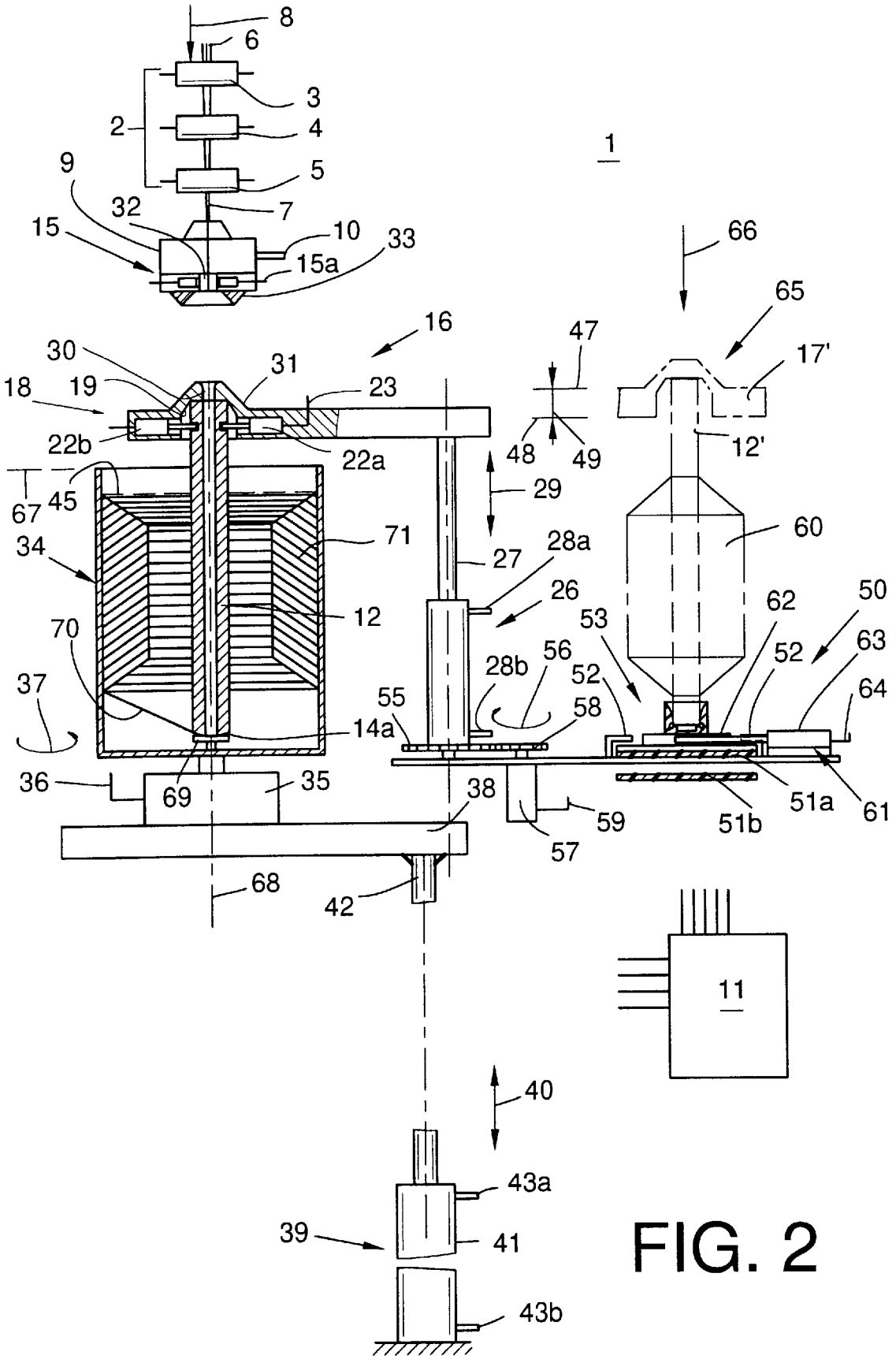
FIG. 2 is another elevational view similar to FIG. 1 depicting the situation at the pot spinning device shortly prior to rewinding of the spinning cake onto the yarn carrier.

The situation shortly before the rewinding of the spinning cake onto the yarn carrier 12 is represented in FIG. 2. The spinning pot 34 has reached its highest position 67. Simultaneously, the yarn carrier 12 has been lowered past its lowest traversing position 48 sufficiently far to seat the outlet opening 14 on a plate 69 which is arranged to be rotatable in the spinning pot coaxial with the spinning pot axis 68. At this time, the drafting system 2 is stopped via the control device 11. The spun yarn 70, which still extends from the mouth 14 to the spinning cake 71 built-up in the spinning pot, is clamped by the engagement of the carrier 12 against the plate 69, whereby the rewinding process of the spinning cake 71 onto the yarn carrier 12 starts immediately.

Once the spinning cake 71 has been completely rewound on the yarn carrier and a spinning cop 60 has thereby been created, as represented in FIG. 1, the spinning pot is lowered into the position represented in FIG. 1, the spinning cop 60 is then pivoted into the transfer position 65, as has already been described above. In the course of this pivoting movement, the yarn 70 is also torn off at the pneumatic piecing aid 9.

Figure 3:
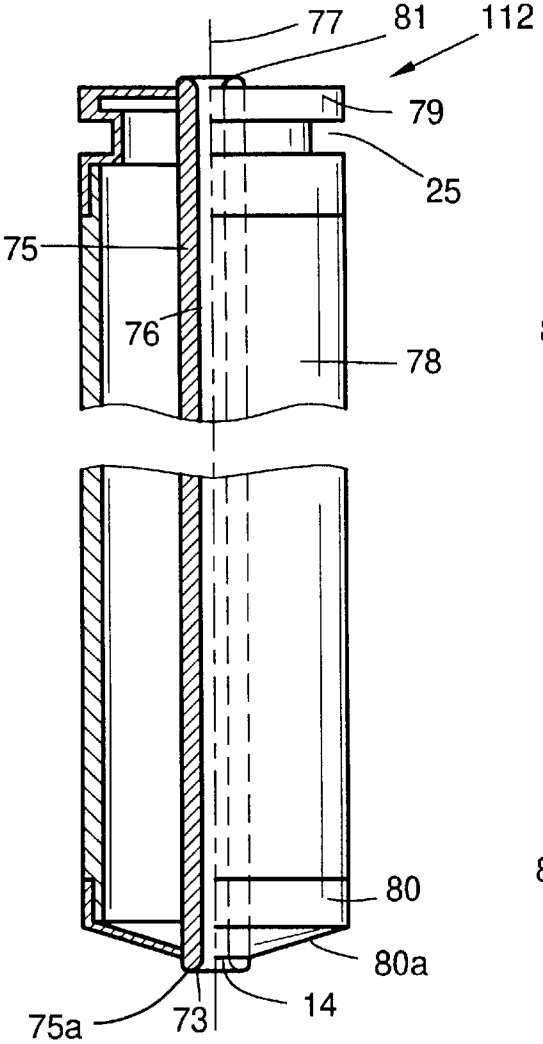
FIG. 3 is an elevational view, partially in cross-section, of a yarn carrier according to the present invention defining a dual conduit.

One of the possible embodiments of a yarn carrier according to the present invention is shown in enlarged form in FIG. 3. This yarn carrier 112 is constructed to provide dual conduits. A relatively thin inner conduit 75, defining a channel 76 having a diameter customary for yarn guide tubes of approximately 3 mm, is centrally arranged coaxial with the axis 77 of a larger diameter outer conduit 78 surrounding the inner conduit 75. The outer conduit 78 has an exterior diameter which is customary for empty bobbins used in connection with pot spinning, for example 20 mm. While the conduit 75 can be made of metal, for example, the exterior conduit 78 can be made of plastic, cardboard or also metal, for example. The exterior conduit 78 and interior conduit 75 are respectively connected at their upper and lower ends by radial bridges closing the openings of the exterior tube. In this embodiment, the upper cover 79 is formed with the encircling groove 25 for holding the yarn carrier in the holder 16. The outward side 80*a* of the lower cover 80 extends in a conical shape at an angle of a few degrees toward the outlet opening 14 of the conduit 75, so that the emerging yarn is not pulled over the edge of the empty bobbin. For this reason the deflecting edge 73 of the small conduit 75 at its mouth 75*a* projects a few millimeters past the lower conduit cover 80. To produce a secure connection of the inner yarn guiding conduit 75 with the pneumatic piecing aid 9, its entry end 81 for receiving the yarn can also project a few millimeters past the upper, flat cover 79. Depending on the material or materials used, the covers and the conduit can be glued or soldered to each other.

Figure 4:
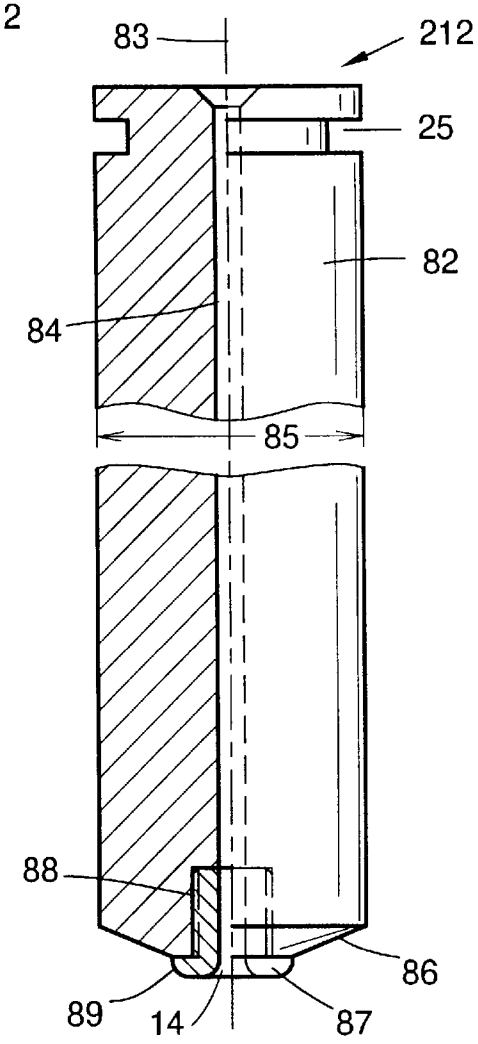
FIG. 4 is an elevational view, partially in cross-section, of a solid yarn carrier according to the present invention.

FIG. 4 shows an enlarged elevational view of another embodiment of yarn carrier 212 made as a solid body, for example from a plastic material. The plastic body 82 has, centered in respect to the longitudinal axis 83, a bore 84 formed as a yarn conduit which also has the customary inner diameter of a yarn guide tube known from pot spinning. The exterior diameter 85 of the yarn carrier 212 can be adapted to the desired empty bobbin diameter and can be, for example, between 16 mm and 20 mm. This yarn carrier also has an encircling groove 25 on its upper end compatible with the gripping and centering device 18. The lower end surface 86, in which the outlet opening 14 of the yarn conduit 84 is centered in respect to the axis 83, also tapers slightly conically toward the yarn outlet opening 14 so that the yarn does not additionally engage the outer edge of the yarn carrier during the cop traverse.

As this exemplary embodiment of a yarn carrier shows, the outlet opening 14 is formed by an annular mouthpiece 87, which is exchangeably threaded into the body 82 by means of the threading 88. If the deflection edge 89, over which the yarn being formed continuously exits the carrier, becomes damaged or worn, the mouthpiece insert 87 can be readily removed and exchanged for a fresh mouthpiece. For enhancing adherence of the yarn layers on the circumferential surface of the plastic body, the outer circumferential surface can be textured (not shown here), for example by grooves of shallow depth.

Figure 5:
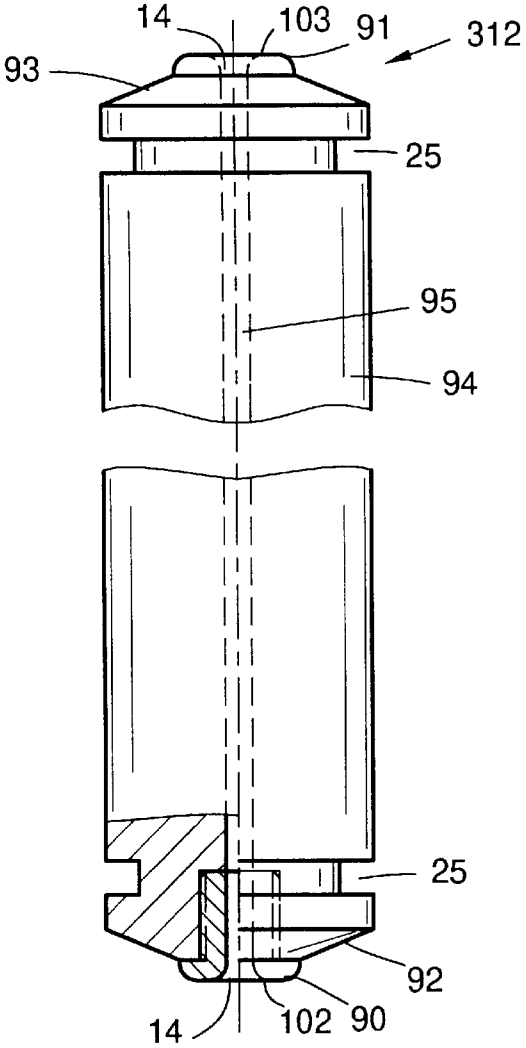
FIG. 5 is an elevational view, partially in cross-section, of a yarn carrier according to the present invention having an arresting device and a yarn outlet opening on both sides.

Another yarn carrier 312, similarly shown in enlarged form in FIG. 5, is a symmetrical yarn carrier, having identical outlet openings 14 formed as mouthpiece inserts 90 and 91 fitted into the opposite carrier ends 92 and 93 which are identically formed in a conical shape tapering in the direction toward the respective mouthpieces. Hereagain, the outer edges 102 and 103 of the mouthpiece inserts for deflecting the yarn project past the outer ends 92 and 93. The body 94 of the yarn carrier 312 can also be a solid body, through which the yarn conduit 95 extends from the mouth 90 to the mouth 91. A groove 25 compatible with the centering and gripping device 18 is formed concentrically in the circumference of the body at both ends of the yarn carrier 312. These yarn carriers have the advantage of not having to be first aligned for automatic handling. Each of the mouths 90 and 91 is designed such that it, together with the outer ends 92 and 93, fits into the correspondingly designed frustoconical recess 19 of the centering and gripping device 18 and can therefore be connected to the opening 30 for feeding in the yarn.

Figure 6:
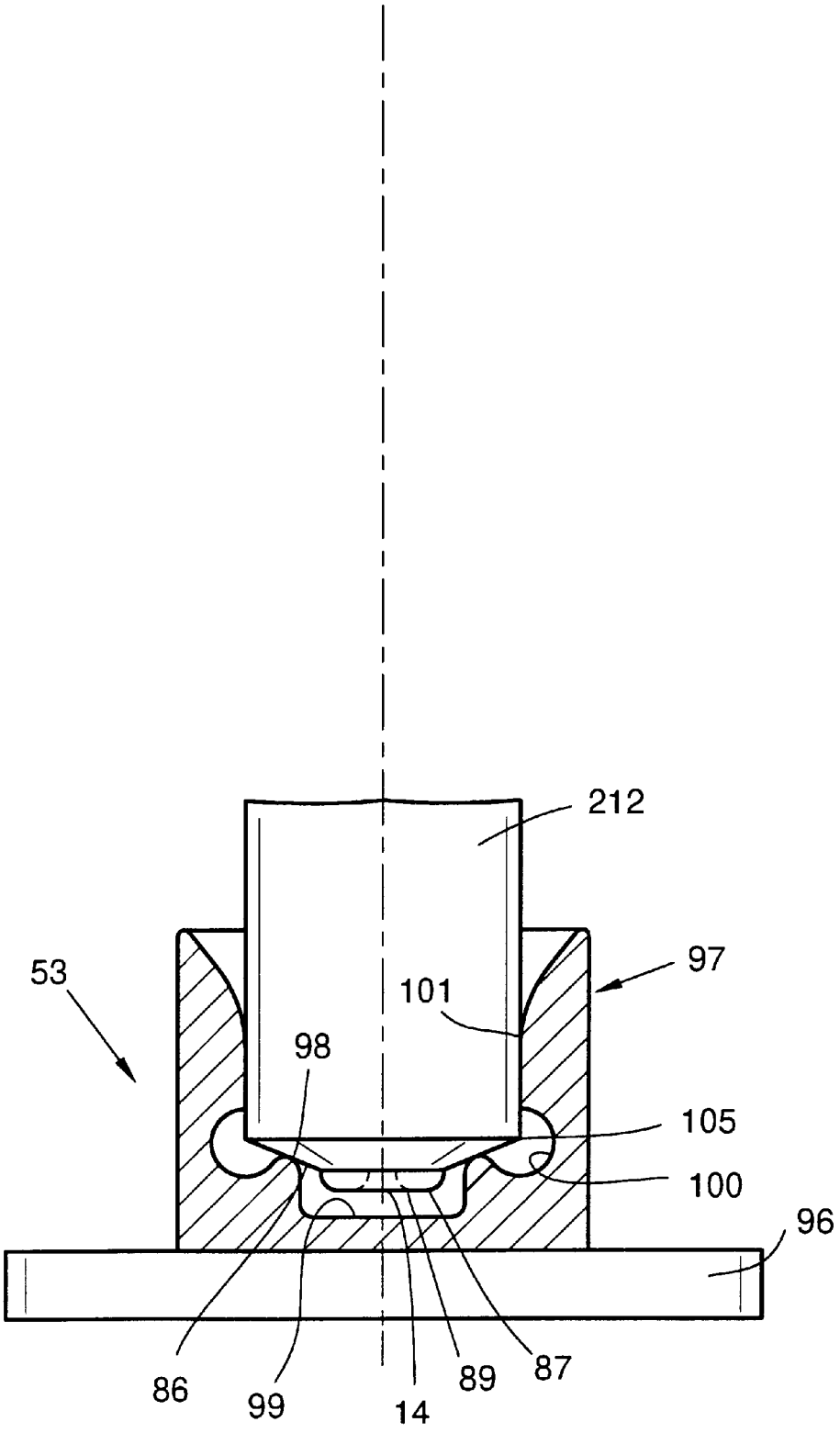
FIG. 6 is a cross-sectional view of a transport holder for a yarn carrier.

A possible embodiment of a transport holder 53 is shown in enlarged form, partially in section, in FIG. 6. The holder 53 comprises a holding element 97 which extends from a disk-like base plate 96. The holding element 97 is formed with an upwardly opening central recess for receiving and gripping a yarn carrier, the recess being defined by an interior wall surface 101 which is tapered outwardly at the open upper end and by a narrowed depression 99 at the interior end surrounded by an annular recess 100 at the inner end of the wall surface 101, between which an annular bead 98 is defined. As indicated by the depiction of an inserted solid yarn carrier 212, the inserted end 86 of the carrier 212 is supported on the annular bead 98 with the centered depression 99 receiving the mouthpiece 87, which therefore does not contact the holding element. The annular recess 100, which surrounds the bead 98, prevents the outer edge 105 of the yarn carrier 212 from becoming jammed together with the holding element 97. On its outer circumference, the yarn carrier is supported by a interior wall surface 101 of the holding element 97. Not shown here in detail, the holding element 97 can be fabricated in a laminated manner in the area of the support wall surface 101 to provide a desired resultant elasticity of the holding element 97 in such area which allows easier removal or insertion of the yarn carriers.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A pot spinning machine for forming a spinning cop, comprising:

a spinning pot having an interior onto which yarn is deposited to form a spinning cake;

a yarn guide which deposits the yarn onto said spinning pot to form the spinning cake;

a yarn carrier onto which the yarn is rewound from the spinning cake to form the spinning cop; and a lifting member that engages, moves, and positions said yarn carrier with respect to said spinning pot;

wherein said yarn guide comprises a yarn passage defined only by said yarn carrier through which the yarn passes in direct exposure to said yarn carrier for deposit in said spinning pot.

2. The pot spinning machine of claim 1, wherein said yarn carrier comprises an outer conduit configured as a yarn winding bobbin and an inner conduit configured as a yarn guide tube fixed coaxially within said outer conduit to define said yarn passage.

3. The pot spinning machine of claim 1, wherein said yarn carrier comprises a solid body having an outer circumferential surface forming a deposit surface for rewinding thereonto of the spinning cake and wherein said yarn passage comprises a central axial bore extending through said solid body.

4. The pot spinning machine of claim 1, wherein a first end of said yarn carrier includes a grippable portion engageable by said lifting member and a second end of said yarn carrier opposite said first end includes an outlet opening of said yarn passage.

5. The pot spinning machine of claim 4, wherein said outlet opening for the yarn comprises an outwardly projecting deflecting edge for guidance of the yarn.

6. The pot spinning machine of claim 4, wherein said outlet opening comprises a removable mouthpiece inserted into said yarn carrier.

7. The pot spinning machine of claim 6, wherein said mouthpiece is made of a wear-resistance material.

8. The pot spinning machine of claim 1, wherein each of two ends of said yarn carrier includes a grippable portion engageable by said lifting member and an opening of said yarn passage.

9. The pot spinning machine of claim 1, further comprising means for executing relative movement between said spinning pot and said yarn carrier.

10. The pot spinning machine of claim 1, further comprising means for actuating rewinding of the spinning cake onto said yarn carrier when said yarn carrier is disposed at a rewinding position.

11. A method of forming a spinning cop at a pot spinning machine, comprising the steps of:

depositing yarn onto an interior of a spinning pot of the pot spinning machine to form a spinning cake; and rewinding the spinning cake onto a yarn carrier to form a spinning cop;

wherein said step of depositing yarn to form the spinning cake includes guiding the yarn onto the interior of the spinning pot by passing the yarn through a passage defined only by the yarn carrier while moving the yarn carrier relative to said spinning pot.

* * * * *